US005173004A

United States Patent [19]

Fahrenkrog

[11] Patent Number: 5,173,004

[45] Date of Patent: Dec. 22, 1992

[54] CONCRETE POURING AND LEVELING DEVICES AND METHOD OF USING

[76] Inventor: William H. Fahrenkrog, 2226 Mississippi Ave., Davenport, Iowa 52803

[21] Appl. No.: 803,523

[22] Filed: Dec. 9, 1991

[51] Int. Cl.[5] ..... E04G 21/20

[52] U.S. Cl. ..... 404/72; 404/118; 33/1 LE

[58] Field of Search ..... 404/72, 118; 52/749; 33/1 LE

[56] References Cited

U.S. PATENT DOCUMENTS

| | | | |
|---|---|---|---|
| 2,586,074 | 2/1952 | Memluck | 33/1 LE |
| 2,873,529 | 2/1959 | Hogan et al. | 404/72 X |
| 4,228,588 | 10/1980 | Horton, Jr. | 33/1 LE X |
| 4,829,439 | 1/1990 | Kiefer | 404/118 X |
| 4,924,579 | 5/1990 | Berendsen | 33/1 LE |

*Primary Examiner*—William P. Neuder

*Attorney, Agent, or Firm*—Robert O. Richardson

[57] ABSTRACT

Concrete pouring and leveling devices and method of using them consisting of vertically placed rigid cylindrical tubes or pipes having reusable yokes inserted at their tops to support screed pipes placed horizontally along the predetermined desired elevation of the concrete surface.

4 Claims, 1 Drawing Sheet

STEP 1
STEP 2
STEP 3
STEP 4
STEP 5
STEP 6
STEP 7
STEP 8

CONCRETE POURING AND LEVELING DEVICES AND METHOD OF USING

BACKGROUND OF THE INVENTION

This invention relates to tools for establishing guides for placing or pouring concrete and similar work in new concrete construction such as a roadway, driveway, sidewalk, patio or building floor.

In the past it was conventional practice to dig out the ground to a desired depth and then place a string line at the predetermined elevation of the finished concrete surface. Wooden stakes were then driven into the ground and pipes were laid horizontally on top of them. The upper surface of the pipes indicate the desired elevation of the finished concrete. Nails were driven into the stake tops on both sides of the pipe to keep it from rolling or being bumped off. The concrete was then poured or dumped into the desired area and struck or screed off with a strike board or screed on top of adjacent pipes. The pipes may be removed while the concrete is drying or setting and the indentations after removal of the pipes are then filled and the surface smoothed out, thus establishing a finished surface at the desired elevation of the concrete.

The use of wooden stakes with nails at their tops is inefficient, costly and time consuming compared to the material, tools and method of using them in the present invention. Wooden stakes are hard to drive so that their tops are at the required depth below the string line. They must be individually measured from the string line with a tape measure. The wooden stakes split easily when driven into the ground or when driving nails into them for holding the screed pipe. Often the accuracy is lost while driving nails in the stake tops in sand or soft soil conditions. In cold climates the wooden stakes swell in the concrete, causing cracks in the concrete.

SUMMARY OF PRESENT INVENTION

In accordance with the present invention the wooden stakes are replaced with cylindrical rigid pipes or tubes which are driven into the ground with a driver having a marker or indicator thereon which is aligned with the string line when the tubes are driven to the proper depth. The driver has a guide that fits into the tube at its upper end. The driver has a shoulder that bears against the upper surface of the tube to drive the tube into the ground when the driver is struck with a sledge or other weighted object. When the marker on the driver is level with the string line, the tube is at its correct height. The driver is then removed and a reusable Y-shaped yoke is inserted into the tube. This yoke cradles the pipe as did the nails in the wooden stakes in the prior art. The concrete is then poured and smoothes as in the prior art. The concrete is then poured and smoothed as in the prior art method. The screed pipe and yoke are removed and their indentations in the cement surface filled, along with the hollow of the tube, to establish a finished surface at the desired elevation of the concrete.

Metallic electrical conduit is excellent material for the cylindrical rigid tubing. PVC plastic tubing or pipe is also ideal for this use.

The procedure of the present invention and using the devices developed to implement the procedure reduces the time and labor to one third that of past procedures. The cost of the devices needed in this new procedure is far less than the savings in using the procedure of the present invention. The plastic or metallic tubes can be driven into hard or rocky soil without breaking or distorting. They cause no damage from swelling in new concrete and the yokes are reusable. Using the driver marker, the tubes may be driven to the desired height without use of a tape measure or concern for driving the tubes too deep or uneven. The present procedure is faster and more reliable than past procedures using wooden stakes with nails at their tops.

DETAILED DESCRIPTION OF PREFERRED EMBODIMENT

Figures 1, 2, 3:
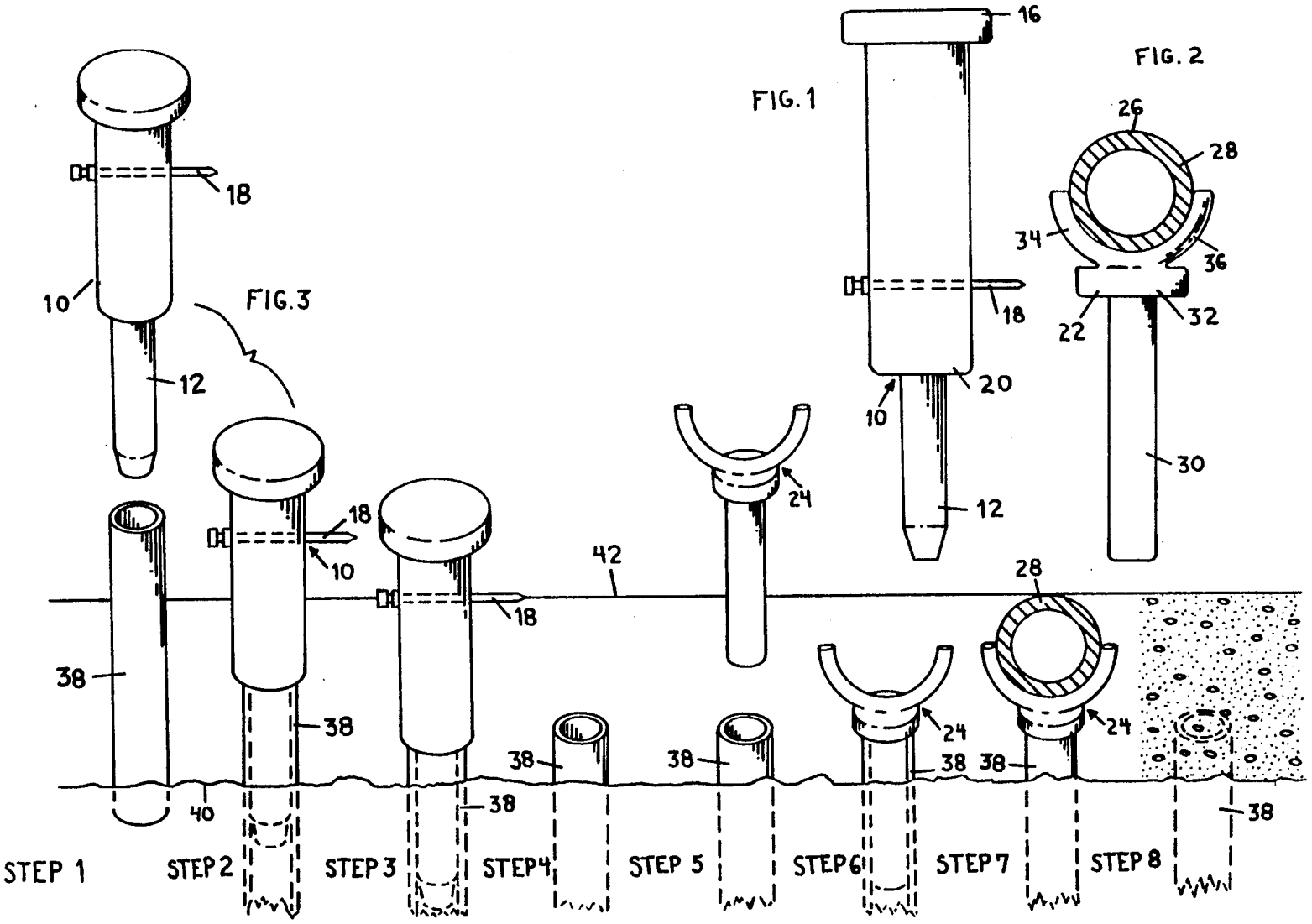
FIG. 1 is a side view of the driver.
FIG. 2 is a side view of the reusable yoke.
FIG. 3 is a side view of a series of drivers, yokes and tubes, illustrating the various steps in the inventive procedure of the present invention.

Reference is made to the driver 10 shown in FIG. 1. This driver consists of a guide 12, handle 14 with driving top 16 and marker or indicator pin 18. Guide 12 is adapted to fit loosely into vertical cylindrical tubes, to be discussed hereinafter with reference to FIG. 3. Guide 12 terminates in a shoulder 20 which is circumferentially larger than the tubes and comprises the lower end of handle 14. The driving top 16 on top of handle 14 may be of the same or larger diameter than handle 14. A hole is drilled into handle 14 and a nail is passed through it to serve as indicator pin 18.

While dimensions disclosed herein are not a critical part of this invention and are not to be construed as a limitation of the invention, nevertheless the following information will assist in the practice of this invention. Assuming a plastic pipe or metallic electric conduit to be driven into the ground has an inside diameter of about 0.615 inches, guide 12 has a diameter of about 0.600 inches, leaving a diameter clearance of about 0.015 inches. A length of about 3 inches prevents buckling of the pipe under the blows of a hammer on the driver although longer or shorter lengths should do as well. Shoulder 20 joins guide 12 with handle 14 which, in this embodiment, has a diameter of about 1.25 inches. The handle length is about 5 inches long although this is not critical. The distance of indicator pin 18 from shoulder 20 is equal to the distance from the shoulder 22 on the yoke 24 in FIG. 2 to the outer top surface 26 of the pipe 28 cradled in the yoke as will be described hereinafter with reference to FIG. 2. Yoke guide 30 preferably is of the same length and diameter as guide 12 on driver 10. It terminates at its upper end with a collar 32 having a shoulder 22 which seats on the top of a cylindrical tube to be used therewith. Collar 32 has a cradle 34 extending upwardly from its upper surface. This cradle may consist of a pair of outwardly directed legs of an arcuate loop 36 adapted to retain a screed pipe 28 along the tops of a plurality of vertically oriented rigid cylindrical tubes used in the finishing of a new concrete area. The loop is wide enough to permit the pipe to be removed by lifting. Since driver 10 receives blows and drives the cylindrical tubes into the ground, it should be made of sturdy material, such as 4140 steel for example. On the other hand, since a plurality of yokes 24 merely retain a screed pipe in a predetermined horizontal position, they may be made of a very inexpensive plastic material. As earlier stated, they are reusable also.

FIG. 3 illustrates eight steps in the procedure of this invention, along with the inventive devices used therein. Step 1 uses a rigid cylindrical pipe or tube 38 longer than the distance from the sub grade 40 to the desired elevation of concrete shown by a previously installed horizontal string line 42. The various tubes used need not be of the same length nor do their upper end surfaces need to be straight since it is the uppermost part of the surface, yoke 24 and pipe 28 that determines the depth to which the tube 38 is driven.

After the tube is positioned vertically into the subgrade, the guide 12 of driver 10 is inserted into the tube top as shown in Step 2. With use of a sledge or hammer, in Step 3 the driver 10 sinks the tube 38 into the sub grade soil 40 until the driver marker 18 is aligned with the concrete elevation finish line 42. Step 4 calls for removal of the driver 10. In Step 5 the yoke 24 is inserted into the top of the positioned tube 38. Step 6 calls for repeating the previous steps with other tubes and yokes in a line to receive the screed pipe 28 placed in the yokes 24 as shown in Step 7. After the concrete lay down is complete and struck off at its finished height the screed pipe 28 and yokes 24 are removed as shown in Step 8. The tube 38 will fill with concrete to eliminate voids in the finished product as any indentations caused by screed pipe 28 and yokes 24 are finally smoothed over.

While the foregoing description relates to the preferred embodiment of this invention, variations will occur to those skilled in this art and it is to be understood that these modifications and alterations are to be considered as part of my invention as defined in the following claims.

What I claim is:

1. Devices for leveling new concrete comprising vertically positioned cylindrical rigid tubes having reusable yokes positioned thereon and screed pipes horizontally positioned on said yokes.

2. The method of leveling new concrete comprising the steps of driving rigid cylindrical tubes into the ground until the tops thereof reach a predetermined elevation, placing yokes into the top openings thereof, said yokes being capable of receiving a horizontal screed pipe thereon, placing said screed pipe thereon, leveling concrete relative to said screed pipe and yokes.

3. The method of leveling new concrete as set forth in claim 2 wherein the step of driving the tubes into the ground includes a driver having a guide insertable into the top of said tube and the step of placing the screed pipe horizontally includes placing a screed pipe handling yoke on the top of said tube in replacement of said driver.

4. The method of leveling new concrete as set forth in claim 3 wherein said screed pipe handling yokes have support guides insertable in the tops of said tubes.

* * * * *